US007480473B2

(12) United States Patent
Matsuura et al.

(10) Patent No.: US 7,480,473 B2
(45) Date of Patent: Jan. 20, 2009

(54) IMAGE FORMATION APPARATUS AND PROCESS CARTRIDGE INCLUDING A TRICKLE DEVELOPMENT SYSTEM AND A CLEANERLESS SYSTEM

(75) Inventors: Nekka Matsuura, Kanagawa (JP); Satoshi Muramatsu, Tokyo (JP); Nobutaka Takeuchi, Kanagawa (JP); Atsushi Shinozaki, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 285 days.

(21) Appl. No.: 11/210,826

(22) Filed: Aug. 25, 2005

(65) Prior Publication Data

US 2006/0045571 A1 Mar. 2, 2006

(30) Foreign Application Priority Data

Aug. 25, 2004 (JP) ..... 2004-244683

(51) Int. Cl.
*G03G 15/30* (2006.01)

(52) U.S. Cl. ..... 399/149; 399/257

(58) Field of Classification Search ..... 399/29, 399/149, 150, 257, 258, 259, 346
See application file for complete search history.

(56) References Cited

U.S. PATENT DOCUMENTS 4,755,847 A 7/1988 Matsushiro et al.
5,797,074 A 8/1998 Kasahara et al.
5,890,049 A * 3/1999 Williams et al. ..... 399/360
5,937,228 A 8/1999 Shoji et al.
5,960,246 A 9/1999 Kasahara et al.
6,285,848 B1 * 9/2001 Aita et al. ..... 399/175
6,366,751 B1 4/2002 Shakuto et al.
6,442,364 B2 8/2002 Kai et al.
6,571,071 B2 5/2003 Kanoshima et al.
6,597,885 B2 7/2003 Kai et al.
6,608,983 B2 8/2003 Terazawa et al.
6,625,409 B2 9/2003 Shakuto et al.
6,628,913 B2 9/2003 Matsumoto et al.
6,654,579 B2 11/2003 Shakuto et al.
6,665,511 B2 12/2003 Takeuchi et al.
6,678,492 B1 1/2004 Terazawa et al.
6,757,509 B2 6/2004 Shoji et al.
6,778,805 B2 8/2004 Kai et al.

(Continued)

FOREIGN PATENT DOCUMENTS

JP 56126876 A * 10/1981

(Continued)

*Primary Examiner*—Robert Beatty
(74) *Attorney, Agent, or Firm*—Oblon, Spivak, McClelland, Maier & Neustadt, P.C.

(57) ABSTRACT

An image formation apparatus and process cartridge exhibiting high durability, in which such disadvantages as irregular recovery of untransferred toner and the advance of carrier degradation are not produced even when jointly using a trickle development system and a cleanerless system, comprising an image support member on which a latent image is formed; a developing unit that houses developer having carrier and toner, develops the latent image formed on the image support member, and recovers untransferred toner remaining on the image support member; a carrier supply unit that supplies carrier to the developing unit; carrier discharge means that discharges carrier housed in the developing unit to outside of the developing unit; and lubricant supply means that supplies lubricant onto the image support member.

19 Claims, 8 Drawing Sheets

U.S. PATENT DOCUMENTS

| | | | | |
|---|---|---|---|---|
| 6,819,901 | B1 | 11/2004 | Yasutomi et al. | |
| 6,823,163 | B2 | 11/2004 | Sugimoto et al. | |
| 6,856,780 | B2 | 2/2005 | Kadota et al. | |
| 6,873,814 | B2 * | 3/2005 | Ohjimi et al. | 399/252 |
| 6,920,301 | B2 * | 7/2005 | Arimoto | 399/227 |
| 2002/0081128 | A1 | 6/2002 | Shakuto et al. | |
| 2002/0090229 | A1 | 7/2002 | Shakuto et al. | |
| 2003/0129511 | A1 * | 7/2003 | Kabata et al. | 430/56 |
| 2004/0091289 | A1 | 5/2004 | Terazawa et al. | |
| 2004/0175207 | A1 | 9/2004 | Shoji et al. | |
| 2004/0190947 | A1 | 9/2004 | Takeuchi et al. | |
| 2004/0253023 | A1 | 12/2004 | Terazawa et al. | |
| 2004/0265014 | A1 | 12/2004 | Takeuchi et al. | |
| 2004/0265015 | A1 | 12/2004 | Koike et al. | |
| 2005/0002054 | A1 | 1/2005 | Shoji et al. | |
| 2005/0095037 | A1 | 5/2005 | Koike et al. | |
| 2005/0163537 | A1 | 7/2005 | Muramatsu et al. | |

FOREIGN PATENT DOCUMENTS

| | | | | |
|---|---|---|---|---|
| JP | 06051563 | A | * | 2/1994 |
| JP | 10123900 | A | * | 5/1998 |
| JP | 2001092219 | A | * | 4/2001 |
| JP | 2001-228668 | | | 8/2001 |
| JP | 2002-62724 | | | 2/2002 |
| JP | 2002244487 | A | * | 8/2002 |
| JP | 2002-278256 | | | 9/2002 |
| JP | 2002-365914 | | | 12/2002 |
| JP | 2003-57882 | | | 2/2003 |
| JP | 2003-177566 | | | 6/2003 |
| JP | 2003195684 | A | * | 7/2003 |
| JP | 2003322986 | A | * | 11/2003 |

* cited by examiner

IMAGE FORMATION APPARATUS AND PROCESS CARTRIDGE INCLUDING A TRICKLE DEVELOPMENT SYSTEM AND A CLEANERLESS SYSTEM

BACKGROUND OF THE INVENTION

1. Field of the Invention

The present invention relates to an image formation apparatus such as a copier, printer, facsimile apparatus or combinations of these, and to process cartridges installed therein. In particular, the present invention relates to an image formation apparatus and process cartridge that uses a trickle development system that suitably discharges degraded carrier from within the developing unit to outside the developing unit, and a cleanerless system that cleans the untransferred toner on the image support member in the developing unit.

2. Description of the Background Art

In the past a variety of technologies were disclosed to make the imaging units in image formation apparatuses of electronic photographic systems more durable. For example, disclosed in Japanese Unexamined Patent Application Publication No. 2002-62724 is a technology to make the imaging unit more durable by using the trickle development system. In more detail, toner and a small quantity of carrier are refilled and excess carrier is discharged from the development unit of a two-component development system in which a magnetic carrier is made to spike up by magnetic force on a developer support member of a developing roller, etc., (suitably called a "magnetic brush" hereinafter) and is made to contact the image support member of a photo-sensitive body, etc., thereby causing toner particles within the magnetic brush to contact the image support member. The intention of this technology was to make the imaging unit more durable by reducing the degradation of image quality caused by degraded magnetic carrier. Specifically, when continuously agitating the magnetic carrier in the development unit of a two component development system, foreign matter such as the parent resin of the toner particles and external additives adhere to the surface of the carrier, and the frictional electrification capacity of the carrier decreases in relation to the toner. Further, mechanical impact causes the coated film of magnetic carriers having a coated film to peel off, and toner is then prone to adhere. Trickle development systems that suitably discharge degraded carrier within the development unit to outside the development unit in this way may be expected to have the effect of reducing deterioration of image quality over time.

Meanwhile, disclosed in Japanese Unexamined Patent Application Publication No. 2002-278256 is a technology to make the imaging unit durable using a cleanerless system. In further detail, the imaging unit of the cleanerless system is not provided with a cleaning unit to mechanically recover with a cleaning blade, etc. untransferred toner on the image support member, specifically, toner that is not transferred to the transfer receiving material in the transfer process and remains on the image support member. The intention of this technology was to make the imaging unit more durable by reducing the abrasion from the image support member caused by contact with the cleaning blade, etc. Concretely, instead of using a cleaning blade, etc. to recover the untransferred toner in the imaging unit of the cleanerless system, many mechanisms are employed which recover and directly reuse untransferred toner in the developing unit. If these kinds of mechanisms are used in an imaging unit of a two-component development system, the untransferred toner recovery characteristics are improved by increasing the relative motional velocities of both opposing parts of the developer support member and the image support member. Consequently, a counter-contact development system is used in which the direction of motion of the image support member is the opposite to the direction of motion of the developer support member (magnetic brush).

Using either of the conventional image formation apparatuses described above, the trickle development system or the cleanerless system, can achieve improved durability of the apparatus. Consequently, it may be expected that further improved durability of the apparatus could be gained by combining the trickle development system with the cleanerless system. However, a variety of problems arise when actually combining the trickle development system and the cleanerless system.

As the result of relentless research, the inventors of the present application discovered the following facts.

First, the case of installing a trickle development system in an image formation apparatus pre-equipped with a cleanerless system will be considered. In a trickle development system, carriers with differing degrees of degradation are essentially mixed together in the interior of the developing unit. Concretely, new carrier just supplied to the development unit together with toner has little foreign material adhering to the surface thereof, and the capacity to cause frictional electrification of the toner is high. In contrast, carrier that has been agitated a long time in the development unit has a large amount of adhering foreign material, and the capacity to cause frictional electrification of the toner is low. Consequently, the distribution of the amount of carrier charge in the magnetic brush is broadened. Moreover, carrier with a large amount of adhering foreign matter has high electrical resistance. Accordingly, fluctuations of the amount of toner particle charge in the magnetic brush are prone to occur. In addition, the development electric field that is formed between the tip of the magnetic brush and the image support member is also prone to become uneven. Further, when the amount of adhering foreign material differs, differences arise in the responsiveness to the magnetic field of the carriers and in the flow characteristics of the carriers. As a result, differences arise in the flexibility and strength as a magnetic brush.

Consequently, when installing a trickle development system in an image formation apparatus pre-equipped with a cleanerless system, fluctuations of the strength of the magnetic field in the tips of the magnetic brush cause irregularities to arise in the capacity to electrostatically draw untransferred toner to the development unit side. In addition, fluctuations of the flexibility and strength of the magnetic brush cause irregularities to arise in the capacity to physically scrape off untransferred toner. Setting the conditions for recovering the untransferred toner by the magnetic brush is delicate, and if irregularities of the recovery capacity of the magnetic brush arise longitudinally, the degree of margin for uniformly recovering untransferred toner across the longitudinal direction is lost.

Next, the case of installing a cleanerless system in an image formation apparatus pre-equipped with a trickle development system will be considered. As described above, when the relative motional velocities of the opposing parts of the image support member and the developer support member have been increased in order to improve the untransferred toner recovery characteristics, the velocity at which the carrier collides with the image support member is heightened. This strengthens the impact when the toner particles on the tip of the magnetic brush collide with the untransferred toner and carrier adhering on the image support member, increasing the adhesion of toner particle parent resin and external additives onto the carrier. Moreover, the impact at the time of collision is prone to cause the coated film of carriers having a coated film to peel off. If degradation of the carrier progresses in this way, differences in carrier characteristics within the magnetic brush will broaden and it will not be possible to achieve uniform development.

Consequently, when installing a cleanerless system in an image formation apparatus pre-equipped with a trickle development system, degradation of the carrier is promoted, and the desired effect cannot be obtained unless the cycle of supplying fresh carrier and discharging degraded carrier is expedited.

SUMMARY OF THE INVENTION

An object of the present invention is to resolve the issues described above, and to provide a durable image formation apparatus and process cartridge without producing the disadvantages of promoting irregular recovery of untransferred toner and carrier degradation even when jointly using a trickle development system and a cleanerless system.

An image formation apparatus in accordance with the present invention comprises an image support member on which a latent image is formed; a developing unit that houses developer having carrier and toner, develops the latent image formed on the image support member, and recovers untransferred toner remaining on the image support member; a carrier supply unit that supplies carrier to the developing unit; a carrier discharge unit that discharges carrier housed in the developing unit to outside of the developing unit; and a lubricant supply unit that supplies lubricant onto the image support member.

A process cartridge in accordance with the present invention is to be installed by freely attaching to and detaching from an image formation apparatus. The image forming apparatus comprises an image support member on which a latent image is formed; a developing unit that houses developer having carrier and toner, develops the latent image formed on the image support member, and recovers untransferred toner remaining on the image support member; a carrier supply unit that supplies carrier to the developing unit; a carrier discharge unit that discharges carrier housed in the developing unit to outside of the developing unit; and a lubricant supply unit that supplies lubricant onto the image support member. The image support member and the developing unit are unified.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
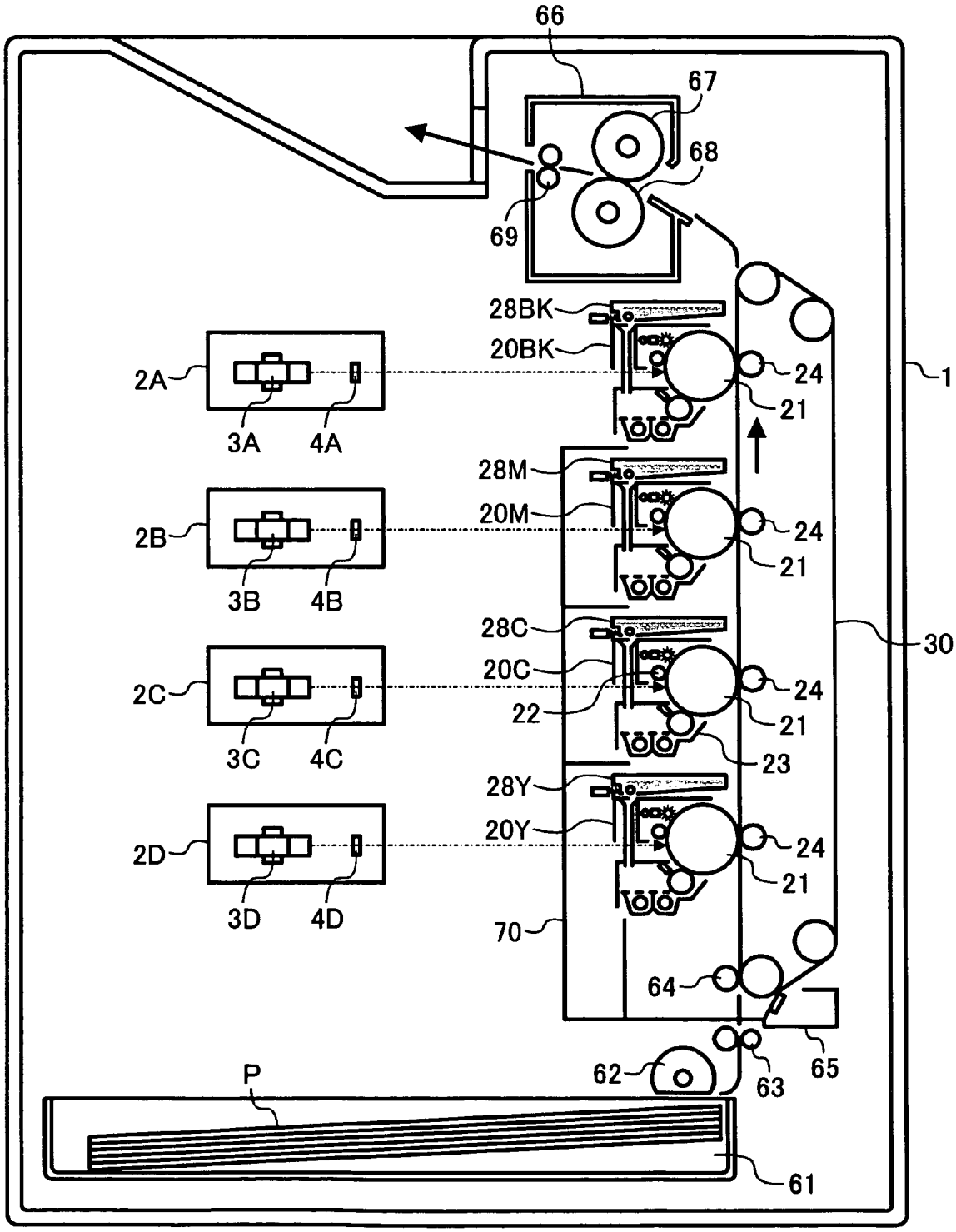
FIG. 1 is a diagram indicating the overall configuration of an image formation apparatus of Embodiment 1 of this invention.

The optimum form for implementing this invention will be described below in detail while referring to the drawings. The same codes will be applied to the same or equivalent parts in the various diagrams, and redundant explanations will be suitably simplified or omitted.

Embodiment 1

This embodiment 1 will be explained in detail using FIGS. 1 to 6.

First, the overall configuration and action of the image formation apparatus of this Embodiment 1 will be explained using FIG. 1.

Write units 2A to 2D are devices for writing electrostatic latent images on a photosensitive drum 21 (image support member) after charge processing based on image data. Write units 2A to 2D are optical scanning devices using polygon mirrors 3A to 3D and optical elements 4A to 4D. Further, LED arrays may be used as the write units instead of optical scanning devices. A paper supply unit 61 houses the transfer receiving material P such as recording paper, OHP, etc., and feeds the transfer receiving material P toward a transfer belt 30 during image formation.

The transfer belt 30 is an endless belt for electrostatically adsorbing and transporting the transfer receiving material P on the surface thereof, and transferring toner images formed on photosensitive drums 21 onto the transfer receiving material P; and an adsorption roller 64 and a belt cleaner 65 are provided on the outer circumference of the belt. Transfer rollers 24 opposite to the photosensitive drums 21 with the transfer belt 30 in between have a metal core and a conductive elastic layer that coats the metal core. The conductive elastic layer of a transfer roller 24 is an elastic body that adjusts the electric resistance value (volume resistance) to an intermediate resistance of $10^6$ to $10^{10}$ Ω·cm by compounding and dispersing a conductivity promoter such as carbon black, zinc oxide or tin oxide in an elastic material such as polyurethane rubber or ethylene-propylene-diene polyethylene (EPDM).

A fixing unit 66 has a heat roller 68 and a pressure roller 67, and uses pressure and heat to fix onto the transfer receiving material P the toner image that is on the transfer receiving material P.

Four process cartridges 20Y, 20C, 20M, and 20BK installed in the longitudinal direction following the transfer belt 30 are for forming toner images of yellow, cyan, magenta and black respectively.

Replenishing cartridges 28Y, 28C, 28M, and 28BK for supplying carrier (magnetic carrier) and various colors (yellow, cyan, magenta, black) of toner particles to the developing units 23 are installed on the process cartridges 20Y, 20C, 20M, and 20BK.

Figure 2:
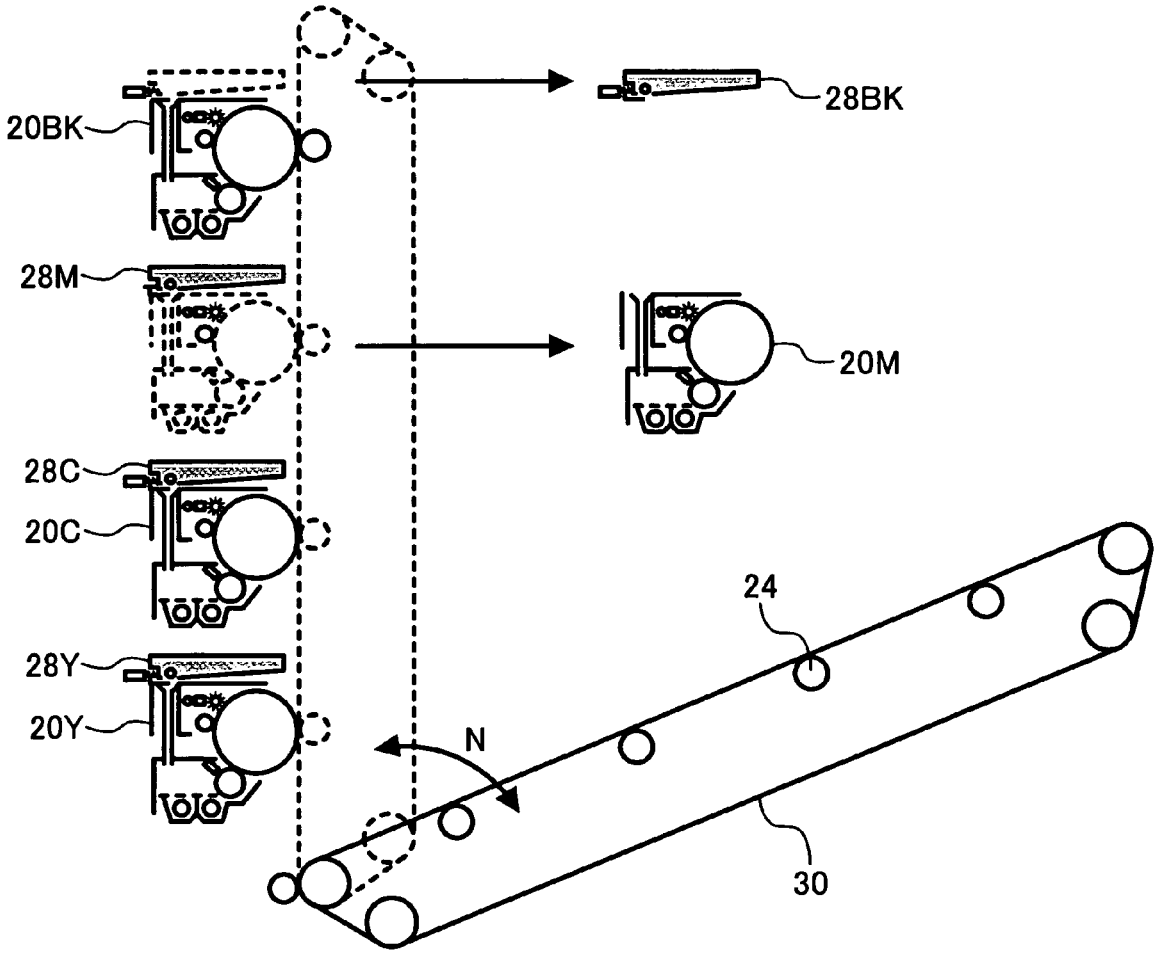
FIG. 2 is a schematic diagram indicating the state with the process cartridge removed from the same image formation apparatus.

Referring to FIG. 2, the process cartridges 20Y, 20C, 20M, and 20BK and the replenishing cartridges 28Y, 28C, 28M, and 28BK can be attached and detached from the apparatus main unit 1 by opening the transfer belt 30 in the direction of the arrow N. In this way, the process cartridges 20Y, 20C, 20M, and 20BK and the replenishing cartridges 28Y, 28C, 28M, and 28BK are replaceable by the user, and can be independently attached, detached and positioned respectively. Specifically, the replenishing cartridges 28Y, 28C, 28M, and 28BK can be individually removed from the apparatus main unit 1, and the process cartridges 20Y, 20C, 20M, and 20BK can be individually removed from the apparatus main unit 1; and the process cartridges 20Y, 20C, 20M, and 20BK and the replenishing cartridges 28Y, 28C, 28M, and 28BK can be removed in a single unit.

As indicated in FIG. 1, a discharge route 70 is provided from below to the side of the process cartridges 20Y, 20C, 20M, and 20BK. The discharge route 70 is for transporting carrier discharged from the developing unit of the process cartridge to the storage space of belt cleaner 65. Further, a transport screw is provided on the interior of the horizontally constructed discharge route 70.

Further, in the state when a replenishing cartridge is retained inside of the apparatus main unit 1 and the process cartridge has been removed, the receiving part of the discharge route 70 is laid out vertically to the opening of the replenishing cartridge so that the interior of the device is not contaminated by developer (toner and carrier) falling from the replenishing cartridge.

The action during image formation will be explained for the image formation apparatus relating to this Embodiment 1 configured as described above.

The image formation apparatus of the present Embodiment 1 is a combined image formation apparatus that functions as a copy machine and a printer. When functioning as a copier, a variety of image processing such as A/D conversion, MTF correction, and gray scale processing are conducted on image data read from a scanner, and the data is converted to write data. When functioning as a printer, image processing is conducted on the image data in a format such as a page description language or bitmap sent from a computer, etc., and the data is converted to write data.

To form an image, exposure light corresponding to the image information of black, magenta, cyan and yellow respectively is irradiated from the write units 2A to 2D in relation to process cartridges 20BK, 20M, 20C, and 20Y. Specifically, exposure light (laser light) oscillated from light sources is irradiated on the photosensitive drums 21 through the polygon mirrors 3A to 3D and the optical elements 4A to 4D. Toner images corresponding to the exposure lights are formed on the photosensitive drums 21 (image support member) of the process cartridges 20BK, 20M, 20C, and 20Y. Then, these toner images are transferred to the transfer receiving material P.

The transfer receiving material P supplied from the paper supply unit 61 is made to match the timing at the position of a resist roller 63, and is transported to the position of the transfer belt 30. An adsorption roller 64 arranged at the intake position of the transfer belt 30 adsorbs the transfer receiving material P, which is fed in by the application of voltage, to the transfer belt 30. Toner images of the various colors are laminated and transferred to the transfer receiving material P, which moves in the direction of the arrow in conjunction with the running of the transfer belt 30, passing through the positions of the process cartridges 20Y, 20C, 20M, and 20BK in order.

The transfer receiving material P onto which the color toner image has been transferred is separated from the transfer belt 30 and arrives at the fixing unit 66. The toner image on the transfer receiving material P is fixed on the transfer receiving material P by pressing together and heating by the pressure roller 67 and the heat roller 68. Meanwhile, the surface of the transfer belt 30 after the transfer receiving material P has been separated then arrives at the position of the belt cleaner 65, and the contamination of toner, etc. adhering to the surface thereof is cleansed.

Figure 3:
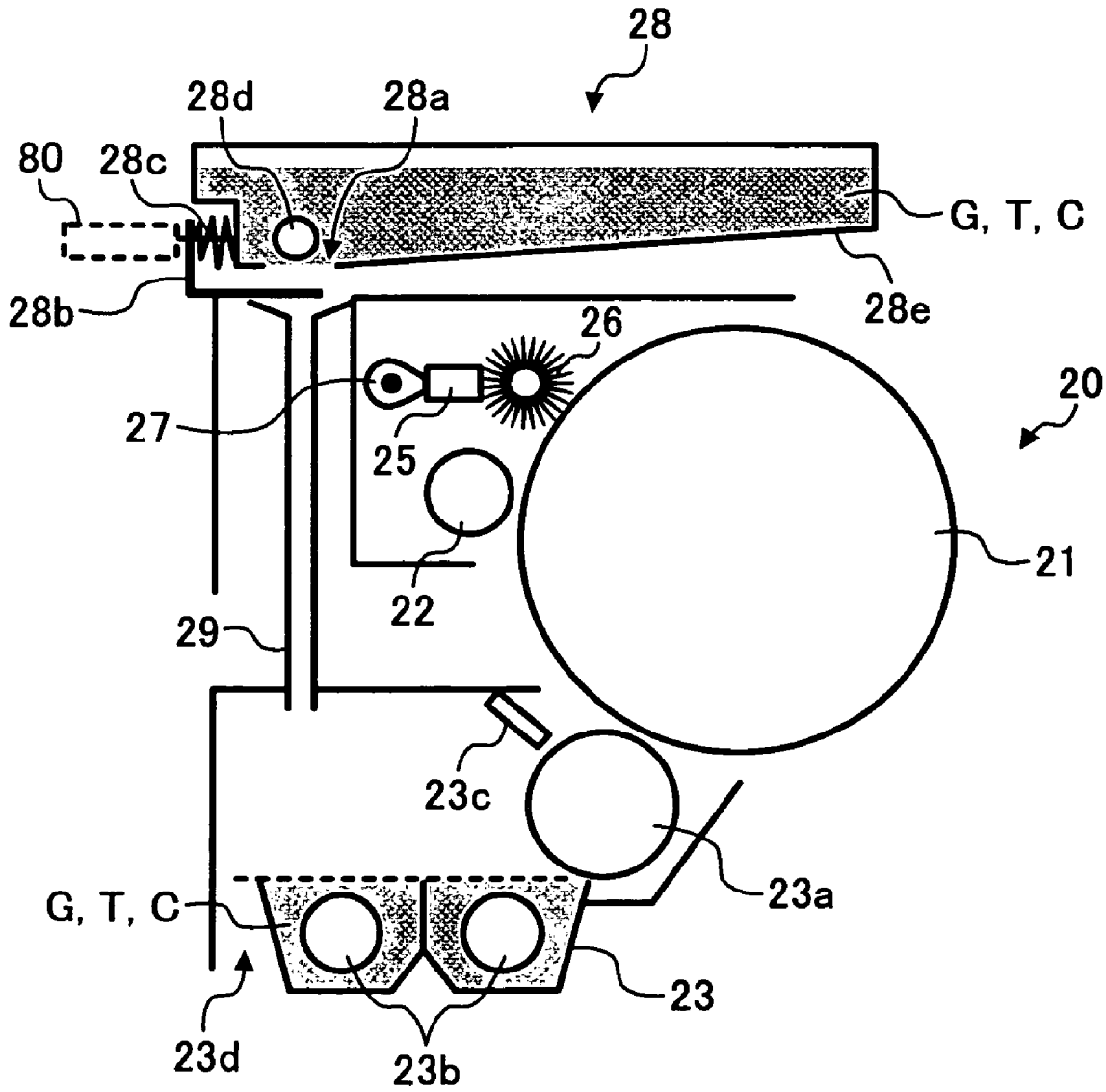
FIG. 3 is a cross-sectional diagram indicating a process cartridge in the state of being removed from the same image formation apparatus.
Figure 4:
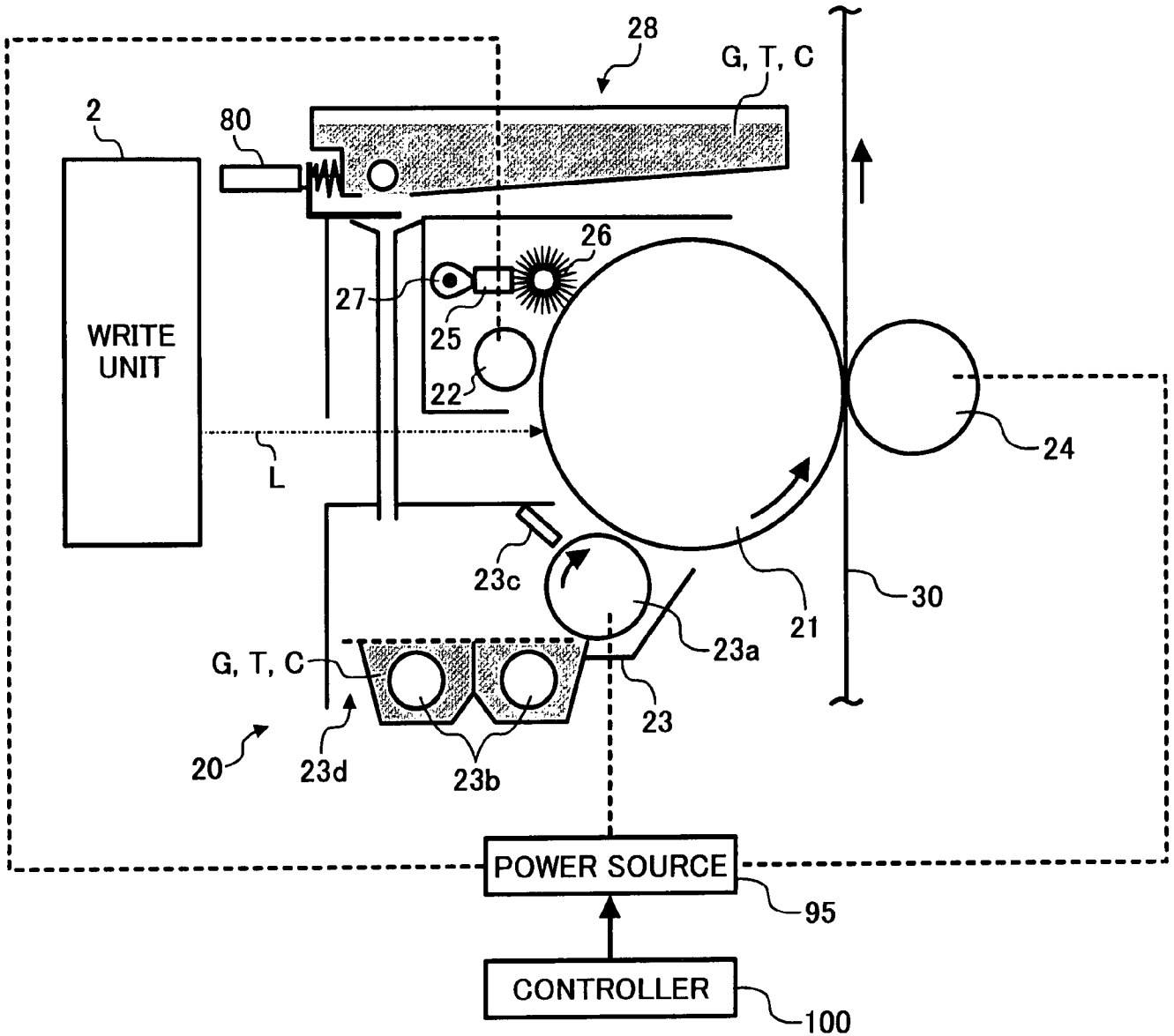
FIG. 4 is an enlarged diagram indicating a process cartridge in the state of being mounted in the same image formation apparatus.

Next, the process cartridges and the replenishing cartridges arranged to freely attach and detach in the image formation apparatus main body 1 will be explained in detail using FIGS. 3, 4, 5, 6A and 6B. Further, all the process cartridges 20Y, 20C, 20M, and 20BK have nearly the same structure, and all the replenishing cartridges 28Y, 28C, 28M, and 28BK also have nearly the same structure, and therefore, the process cartridges and the replenishing cartridges are indicated in FIGS. 3 and 4 without the alphabetic codes (Y, C, M, BK). Moreover, the writing units are indicated without the alphabetic codes (A to D).

FIG. 3 indicates the process cartridge 20 and the replenishing cartridge 28 when removed from the apparatus main unit 1, and FIG. 4 indicates the process cartridge 20 and the replenishing cartridge 28 when mounted in the apparatus main unit 1.

As indicated in FIGS. 3 and 4, the process cartridge 20 is unified with the photosensitive drum 21 as the image support member, the charge unit 22, the developing unit 23, and lubricant supply means 25 to 27, and a trickle development system and a cleanerless system are jointly used.

Referring to FIGS. 3 and 4, the photosensitive drum 21 is a negative charge organic photosensitive member with an external diameter of 30 mm, and is driven rotationally counterclockwise by a rotational drive mechanism not indicated in the diagram at a surface velocity of 100 mm/second.

The charge unit 22 is an elastic charge roller in which a foam urethane layer with intermediate resistance (about $10^6$ to $10^9$* Ω·cm) formulated with urethane resin, carbon black as the conductive particles, a sulfurizing agent, and a foaming agent, etc. is formed in a roller shape on a metal core. Rubber materials in which conductive material for adjusting the resistance such as carbon black, or metal oxides are dispersed in urethane, ethylene-propylene-diene polyethylene (EPDM), butadiene acrylonitrile rubber (NBR), silicone rubber, or isoprene rubber, etc., or foams of these, may be used as the material of the intermediate resistance layer of the charge unit 22. The charge unit 22 is arranged so as to not make contact by having a gap of about 5 to 200 μm in relation to the photosensitive drum 21 based on spacers of tape adhering circumferentially on the longitudinal ends.

A developing roller 23*a* is arranged within the developing unit 23 as the developer support member adjacent to the photosensitive drum 21, and the development region in which the photosensitive drum 21 and the magnetic brush make contact is formed in the opposing parts of the pair.

The developing roller 23*a* is configured such that a sleeve 23*a*2 (refer to FIG. 5) comprising a non-magnetic member of aluminum, brass, stainless steel, or conductive resin, etc. formed in a cylindrical shape rotates clockwise by a rotational drive mechanism not indicated in the drawing. The outer diameter of the sleeve 23*a*2 is 20 mm, and the motile velocity of the surface is set to 250mm/second. Moreover, the space (developing gap) between the photosensitive drum 21 and the developing roller 23*a* is set to 0.4 mm.

A doctor blade 23*c* that regulates the amount of developer on the sleeve 23*a*2 is arranged on a part on the upstream side of the development region in the direction of transporting the developer G. The space (doctor gap) between the doctor blade 23*c* and the developing roller 23*a* is set to 0.4 mm. Further, developer G comprising toner T and carrier C is housed in the housing unit of the developing unit 23, and while circulating longitudinally the developer G is agitated and stirred by two transport screws 23*b* (FIG. 3 and FIG. 4). One of the transport screws 23*b* opposing the developing roller 23*a* has a function to draw the developer G in the housing unit up onto the development roller 23*a*.

Figure 5:
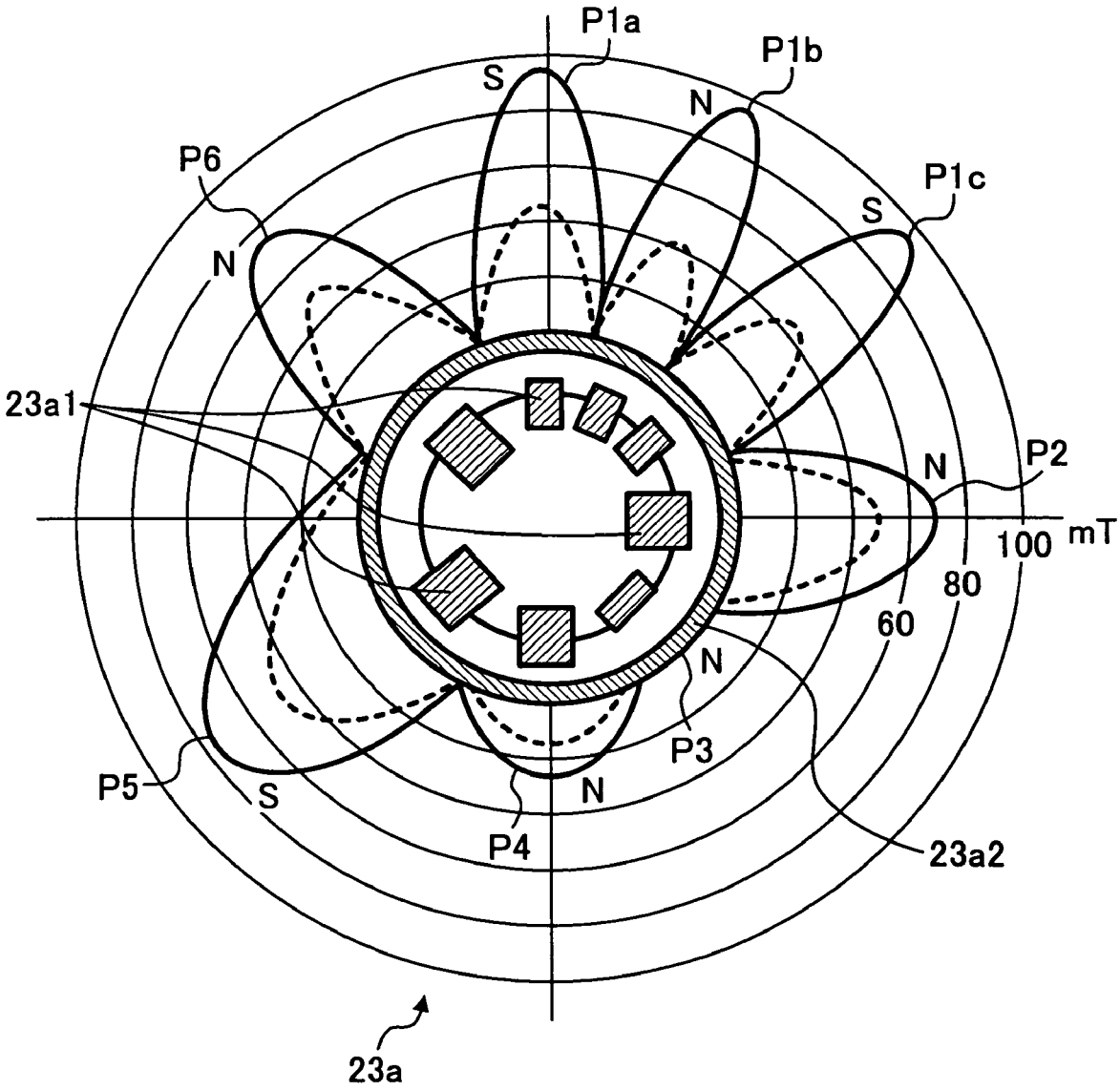
FIG. 5 is a circular chart graph indicating the magnetic flux distribution formed around the development roller of the development unit.

Referring to FIG. 5, magnets 23*a*1 (magnetic field generating members) that form magnetic fields are secured in the developing roller 23*a* in order to generate spikes of the developer G on the circumferential surface of the sleeve 23*a*2. The carrier C in the developer G spikes up in a chain shape on the sleeve 23*a*2 following the normal direction of magnetic force lines generated from the magnets 23*a*1. The charged toner T adheres to the carrier C that has spiked up in this chain shape, and a magnetic brush is formed. The magnetic brush moves in the same direction (clockwise) as the sleeve 23*a*2 based on the rotation of the sleeve 23*a*2.

Multiple magnetic poles are formed on the sleeve 23*a*2 by the multiple magnets 23*a*1. Concretely, provided in the development region part are: main magnetic pole P1*b* for forming a spike of developer G, supplementary magnetic poles P1*a*, P1*c* that supplement the magnetic force formation of the main magnetic pole P1*b*, lifting magnetic pole P4 for lifting up developer G onto the sleeve 23*a*2, transport magnetic poles P5 and P6 that transport the lifted developer G up to the development region, transport magnetic pole P2 that transports the developer G after the developing process, and cutting magnetic pole P3 that disengages and returns the developer G from the sleeve 23*a*2 to the storage unit.

The main magnetic pole group is configured such that the poles are adjacent in the order from the upstream side of: the supplementary magnetic pole P1*a*, the main magnetic pole P1*b*, and the supplementary magnetic pole P1*c*. These magnets 23*a*1 that form magnetic poles with small transverse sections are made from rare earth metal alloys, but samarium alloy magnets (specifically, samarium-cobalt alloy magnets), etc. may be used. Representative of rare earth metal alloy magnets are neodium iron boron alloy magnets, which have a maximum energy product of 358 kJ/m$^3$, and neodium iron boron alloy bond magnets, which have a maximum energy product of 80 kJ/m$^3$. By using this kind of magnet, the necessary developing roller surface magnetic force can be guaranteed in a compact size.

As indicated in FIG. 5, main magnetic pole P1*b*, lifting magnetic pole P4, transport magnetic poles P2 and P6, and cutting magnetic pole P3 have N polarity, and the other magnetic poles, P1*a*, P1*c* and P5, have S polarity. As indicated by the solid lines in FIG. 5, which is a circular chart graph measuring the magnetic flux density in the normal direction, the main magnetic pole P1*b* has a normal direction magnetic force of 85 mT or more above the developing roller. The downstream supplementary magnetic pole P1*c* has a magnetic force of 60 mT or more. The width of the magnets of the main magnetic pole P1*b*, and supplementary magnetic poles P1*a* and P1*c* is 2 mm, and the peak width at half height of the main magnetic pole P1*b* is 16°.

In FIG. 5 the solid lines indicate the magnetic flux density in the normal direction on the surface of the sleeve 23*b*2, and the dotted lines indicate the magnetic flux density in the normal direction at the position separated 1 mm from the surface of the sleeve 23*a*2. Further, to measure the magnetic flux density, a "Gauss Meter (HGM-8300)" (manufactured by ADS) and a "Model A1 Axial Probe" (manufactured by ADS) were used as the measurement instruments, and a circular chart recorder was used as the recording device.

In the present embodiment 1 the normal direction magnetic flux density on the sleeve surface of the main magnetic pole P1*b* was 95 mT; the normal direction magnetic flux density at the position separated by 1 mm from the sleeve surface was 44.2 mT; and the amount of change of magnetic flux density was a magnetic flux difference of 50.8 mT. The modulus of decay of the normal direction magnetic flux density at this time was 53.5%. Further the modulus of decay of the normal direction magnetic flux density is the percentage obtained by taking the difference between the peak value of the normal direction magnetic flux density at the surface of the sleeve and the normal direction magnetic flux density of the position separated 1 mm from the surface of the sleeve and dividing by the peak value of the normal direction magnetic flux density at the surface of the sleeve.

Moreover, the normal direction magnetic flux density on the sleeve surface of the supplementary magnetic pole P1*a* positioned upstream from the main magnetic pole P1*b* was 93 mT; the normal direction magnetic flux density at the position separated by 1 mm from the sleeve surface was 49.6 mT; and the amount of change of magnetic flux density was a magnetic flux difference of 43.4 mT. The modulus of decay of the normal direction magnetic flux density at this time was 46.7%.

The normal direction magnetic flux density on the sleeve surface of the supplementary magnetic pole P1*c* positioned downstream from the main magnetic pole P1*b* was 92 mT; the normal direction magnetic flux density at the position separated by 1 mm from the sleeve surface was 51.7 mT; and the amount of change of magnetic flux density was a magnetic flux difference of 40.3 mT. The modulus of decay of the normal direction magnetic flux density at this time was 43.8%.

The magnetic brush formed following the lines of magnetic force manifests the electrostatic image on the photosensitive drum 21, with only the brush part formed on the main magnetic pole P1*b* making contact with the photosensitive drum 21. Here, the length of the magnetic brush at the location of contact measured in the state when the photosensitive drum 21 has not made contact is approximately 1.5 mm, and forms a denser magnetic brush with a shorter spike than the length of a conventional magnetic brush (approximately 3 mm).

The magnetic brush in the development region may be made short and dense in this way by setting the modulus of decay of the normal direction magnetic flux density at 40% or more. As a result, uniform development may be achieved, and the efficiency of the recovery to developing unit 23 of the untransferred toner remaining on the photosensitive drum 21 is improved. Further, if a lubricant in a congealed state is present on the photosensitive drum 21, this efficiency is extended, and the effect of uniformly coating the surface of the photosensitive drum 21 is heightened.

The developer G comprising the toner T and the carrier C is housed in the developing unit 23. As a binder resin, the toner T uses substances in which polymeric monomers of styrene groups and acryl groups together with a polymerization initiator are dispersed in water and radical polymerized, and substances in which polyester resins are dispersed in water and highly polymerized by a polymer addition reaction. The toner T is a non-magnetic toner particle with a weight average particle size of approximately 5 μm obtained by adding a colorant and charge control additives, etc. to the binder resin described above, and making particles.

The carrier C is a substance formed such that the amount of magnetization in a magnetic field of one kilo-Oersted is in the range of 30 to 200 emu/cm$^3$.

If a low magnetized carrier C with the amount of magnetization at 200 emu/cm$^3$ or less (preferably, 140 emu/cm$^3$ or less), the magnetic interaction with the neighboring magnetic brush will be small, and the spike of the magnetic brush will be fine and short. As a result, uniform development can be achieved, and the characteristics of recovering the untransferred toner remaining on the photosensitive drum 21 to the developing unit 23 are improved. Further, if a lubricant in a congealed state is present on the photosensitive drum 21, this efficiency is extended, and the effect of uniformly coating the surface of the photosensitive drum 21 is heightened.

Moreover, if the amount of magnetization of the carrier is less than 30 emu/cm$^3$, not only does the adhesion of the carrier to the photosensitive drum 21 increase, but the ability to magnetically transport and coat the developer G on the developing roller 23*a* disappears. For this reason, the amount of magnetization of the carrier is set to 30 emu/cm$^3$ or more (preferably, 80 emu/cm$^3$ or more).

Further the amount of carrier C magnetization is derived as follows.

First, using an "oscillating magnetic field type magnetic characteristics auto-recording device" (manufactured by Riken Electronics) to measure the magnetic characteristics of the carrier, carrier packed in a cylindrical container is placed in an external magnetic field of 1 kilo-Oersted, and the strength of magnetization is measured. Then, the amount of magnetization is calculated by multiplying the absolute specific gravity of the carrier by the measured strength of magnetization.

In this embodiment 1, a resin magnetic carrier with dispersed magnetic material produced by polymerization comprising at least a binder resin, a magnetic metal oxide and a non-magnetic metal oxide was used as the carrier C. Concretely, magnetite ($Fe_3O_4$) was used as the magnetic metal oxide. A resin obtained by polymerizing styrene and vinyl monomers such as ethyl acrylate was used as the binder resin with dispersed and bound metal oxides. Carrier in which the magnetic substance is dispersed in the binder resin may be directly used, but it is also possible to use this as the core of a coated magnetic carrier in which the surface of the carrier core is coated with an insulative resin as a coating agent.

Referring to FIGS. 3 and 4, a discharge outlet 23*d* (carrier discharge means) for discharging excess developer G is provided in the developing unit 23. When developer G is excessive and exceeds the specified height (position indicated by the dotted line in the diagram) of the storage unit, the overflowing developer G is discharged from the discharge outlet 23*d*. The developer G that has been discharged from the discharge outlet 23*d* passes through the discharge route 70 and is housed in the belt cleaner 65. Carrier contaminated by the parent resin of the toner T or by external additives is automatically discharged to outside the developing unit, and therefore degradation of the image quality can be suppressed over the passage of time.

A lubricant supply means, comprising a solid lubricant 25, a brush roller 26 for supplying the lubricant 25 onto the photosensitive drum 21, and a cam 27 for making the brush roller 26 break contact with the photosensitive drum 21, is set up in the process cartridge 20. The solid lubricant 25 has a metal soap such as zinc stearate, or PTFE (polytetraf luoroethylene), etc. as the main component, and is energized and makes contact with the brush roller 26 by an energizing means not indicated in the diagram.

A gear is set up in the axle of the longitudinal end of the brush roller 26, and this gear meshes with a gear set up on the axle of the end part of the photosensitive drum 21. The brush roller 26 thereby rotates via the drive force transmitted from the photosensitive drum 21, and coats the photosensitive drum 21 with lubricant.

In this way, in the image formation device of the present Embodiment 1, a lubricant is coated on the photosensitive drum 21, and therefore, the transfer percentage is improved, and the percentage of recovery of untransferred toner to the development apparatus is raised.

Moreover, cam 27 is set up in the lubricant supply means 25 to 27, and the brush roller 26 can break contact with the photosensitive drum 21 based on the rotation of the cam 27. In a cleanerless system, if the brush roller 26 always makes contact with the photosensitive drum 21, the untransferred toner remaining on the photosensitive drum 21 becomes mixed in with the lubricant in the brush roller 26, and cannot be recovered by the developing unit 23. Consequently, in the present Embodiment 1, this is controlled such that the brush roller 26 is separated from the photosensitive drum 21 during image formation.

Further, the contact state (contact pressure, contact angle, .etc.) of the brush roller 26 with the photosensitive drum 21 can be suitably set depending on the photosensitive drum 21 and how much lubricant is to be mixed in by the developing unit 23.

A refill tube 29 is for the purpose of reliably supplying the housing unit of the developing unit 23 with developer G (toner T and carrier C) discharged from the replenishing cartridge 28. Specifically, the developer G discharged from the replenishing cartridge 28 is supplied into the developing unit 23 through the refill tube 29.

The replenishing cartridge 28 houses the developer G (toner T and carrier C) for refilling into a frame 28*e*. Then, the replenishing cartridge 28 functions as a toner cartridge to supply new toner T to the developing unit 23, and also functions as the carrier supply unit to supply new carrier C to the developing unit 23. Here, if a mixture percentage of carrier C to toner T is set high for the developer G of the replenishing cartridge 28, the refresh effect of the carrier C in the developing unit 23 is increased, but then the quantity of developer G discharged from the developing unit 23 also becomes larger. In the present embodiment 1, a balance of both was taken into consideration, and the mixture percentage of developer G within the replenishing cartridge 28 was set to 0.5 to 3 weight parts of carrier to 100 weight parts of toner.

Just enough of a gap to grasp the frame 28*e* of the replenishing cartridge 28 during attachment and detachment is provided between the frame and the process cartridge 20 on the transfer belt 30 side. Moreover, a slant running from the transfer belt 30 side to a supply opening 28*a* side is provided in the frame 28*e*, and allows the developer G inside the replenishing cartridge 28 to move smoothly toward the supply opening 28*a*.

A cover 28*b* of the replenishing cartridge 28 is arranged on the frame 28*e* through a spring 28*c*.

Figure 6A:
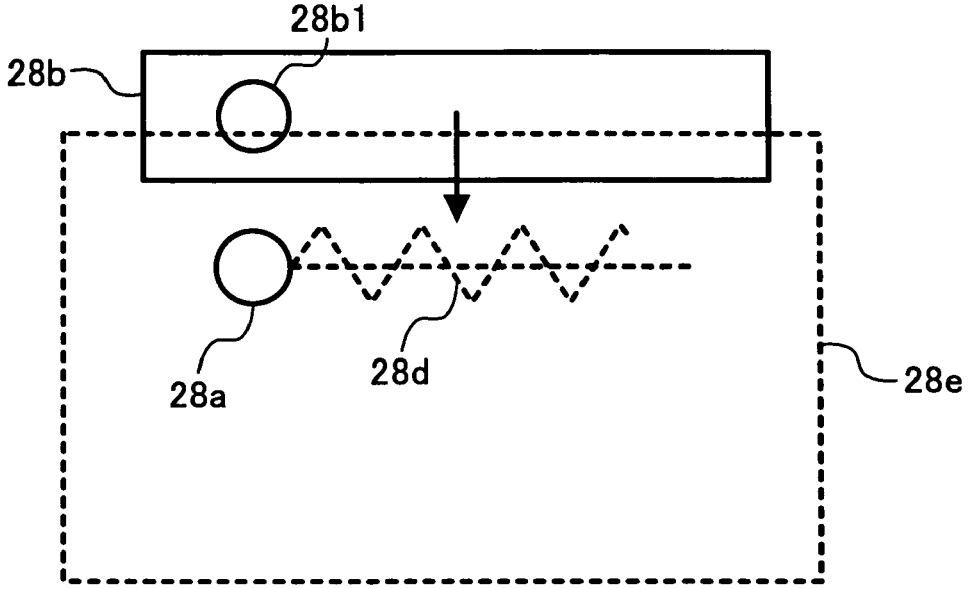
FIGS. 6A and 6B are schematic diagrams indicating the states of the carrier supply unit when mounted and detached in the same image formation apparatus.
Figure 6B:
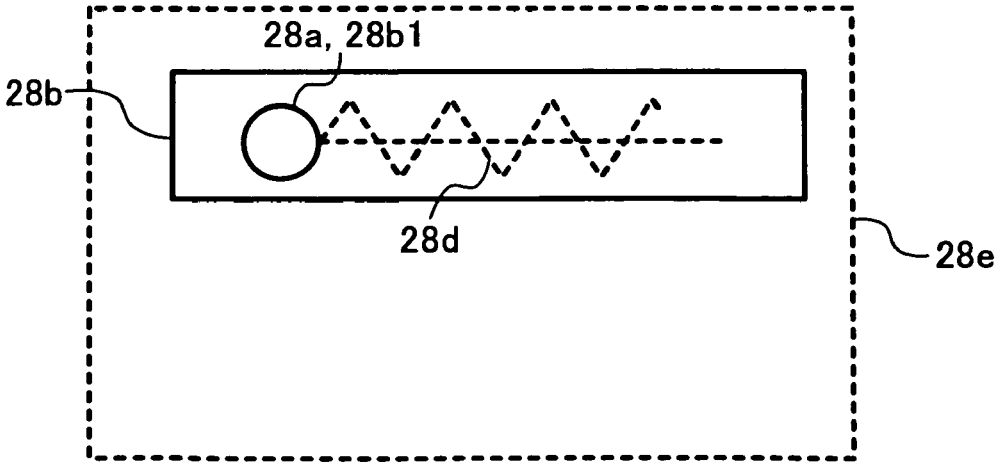

Referring to FIG. 6 that views the replenishing cartridge 28 from below, in the state when the replenishing cartridge 28 is mounted in the apparatus main unit 1, the cover 28*b* is pressured by a protrusion provided in the apparatus main unit 1 that overcomes the energizing force of the spring 28*c*, and moves to the frame 28*e* side (the state of FIG. 6B). In the state when the replenishing cartridge 28 is removed from the apparatus main unit 1, the cover 28*b* moves to the side separated from the frame 28*e* based on the energizing force of the spring 28*c* (the state of FIG. 6A).

As indicated in FIG. 6A, in the state when the replenishing cartridge 28 is removed from the apparatus main unit 1, an opening 28*b*1 of the cover 28*b* is separated from the supply opening 28*a*, and the supply opening 28*a* is shut by the cover 28*b*. Developer G inside of the replenishing cartridge 28 is thereby prevented from leaking to the outside.

As indicated in FIG. 6B, in the state when the replenishing cartridge 28 is mounted in the apparatus main unit 1, the opening 2811 of the cover 28*b* moves to the position of the supply opening 28*a*, and the supply opening 28*a* and the opening 28*b*1 coincide. Developer G inside of the replenishing cartridge 28 is thereby supplied to the developing unit 23.

Further, a screw 28*d* is provided in the replenishing cartridge 28, and transports the developer G inside the cartridge toward the supply opening 28*a*. In detail, the screw 28*d* is rotationally driven by a drive transmission mechanism not indicated in the diagram, and sends the developer G to the supply opening 28*a* at a specified timing. Then, the developer G discharged from the supply opening 28*a* is supplied to the developing unit 23.

Next, the action of the process cartridge 20 and the replenishing cartridge 28 will be explained.

Referring to FIG. 4, when the photosensitive drum 21 is rotationally driven counterclockwise, first, the surface of the photosensitive drum 21 is charged to approximately −400 V at the position of a charge unit 22. Concretely, overlapping voltages of a DC voltage of −400 V and of a sinusoidal AC voltage with a frequency of 1000 Hz and voltage between peaks of 1400 V are applied to the core of the charge unit 22 from a power source unit 95.

Subsequently, the surface of the charged photosensitive drum 21 reaches the irradiation position of an exposure light L, and exposure processing is conducted based on the write unit 2. Specifically, a difference in electrical potential (electrical potential contrast) from the non-image part that is not irradiated is generated and an electrostatic latent image is formed by using the irradiation of exposure light L to selectively neutralize the photosensitive drum 21. Further, in this exposure processing, a charge generating substance in the photosensitive layer of the photosensitive drum 21 receives the light and generates a charge, and the positive holes in this cancel the charge load on the surface of the photosensitive drum 21.

Subsequently, the surface of the photosensitive drum 21 on which the latent imaged is formed reaches the position opposing the developing unit 23. The electrostatic image on the photosensitive drum 21 comes in contact with the magnetic brush on the developing roller 23*a*, and is made visible by the adhesion of the negatively charged toner T in the magnetic brush.

In more detail, the developer G, which has been taken up by the magnetic force based on the magnetic pole of the developing roller 23*a*, is optimized by the doctor blade 23*c*, and is then transported to the development region, which is the part opposite the photosensitive drum 21. The carrier C that has spiked up in the development region by the previously described main magnetic pole P1*b* rubs against the photosensitive drum 21. At this time, the toner T that is mixed with the carrier C is negatively charged by the friction with the carrier C. In contrast, the carrier C is positively charged. A DC bias of −300 V and an AC voltage with a frequency of 1.3 kHz and voltage between peaks of 1600 V are applied to the developing roller 23*a* from the power source 95. An electric field is thereby formed between the developing roller 23*a* and the photosensitive drum 21; the electric field causes the negatively charged toner T to selectively adhere only to the image part on the photosensitive drum 21, and a toner image is formed.

Afterwards, the surface of the photosensitive drum 21 on which the toner image is formed arrives at the position opposite the transfer belt 30 and the transfer roller 24. Then, the toner image on the photosensitive drum 21 is transferred onto the transfer receiving material P that was transported to the opposing position at a matching timing. At this time, the specified voltage is applied to the transfer roller 24 from the power source part 95 controlled by a controller 100. Subsequently, the transfer receiving material P onto which the toner image has been transferred passes through a fixing unit 66, and is discharged to the outside of the apparatus by a discharge roller 69.

Meanwhile, the toner T (untransferred toner), which is not transferred to the transfer receiving material P and remains on the photosensitive drum 21, reaches the part opposing the charge unit 22 while still adhering to the photosensitive drum 21. Then the untransferred toner on the photosensitive drum 21 is negatively charged by an electrical discharge produced by the charge voltage of the charge unit 22.

Here, a large amount of reverse charged toner and weakly charged toner is included in the untransferred toner remaining on the photosensitive drum 21. In order to recover this kind of untransferred toner to the developing unit 23, it is necessary that the amount of charge of the untransferred toner be close to the normal amount of charge. In the present Embodiment 1, a charge system is used that charges the photosensitive drum 21 by an electric discharge, and the untransferred toner is also charged by the electric discharge, and gains an amount of charge that allows recovery to the developing unit 23. Further, the molecular weight of the untransferred toner is lowered by the physical impact of the electrical discharge and by the chemical reaction with the radical produced during the electrical discharge, and at the same time external additives that adhere to the untransferred toner are prone to be released.

Subsequently, the negatively charged untransferred toner on the photosensitive drum 21 passes through the exposure light L irradiation position, and arrives at the part opposing the developing roller 23*a*. Then, the untransferred toner adhering to the image part of the electrostatic latent image remains on the photosensitive drum 21 based on the development electric field. In contrast, the untransferred toner adhering to the non-image part moves onto the developing roller 23*a* based on the development electric field, and is returned to within the developing unit 23.

In the present Embodiment 1, recovery of the untransferred toner can take place effectively and the effect of the lubricant adhering to the carrier can also be improved because the motional velocity at the surface of the developing roller 23*a* is set to 2.5 times the motional velocity at the surface of the photosensitive drum 21. Further, the counter development system, in which the direction of motion of the surface of the development roller 23*a* in the development region is opposite to the direction of motion of the surface of the photosensitive drum 21, can be used because the relative speeds of the developing roller 23*a* and the photosensitive drum 21 becomes large.

Moreover, in the image formation apparatus of the present Embodiment 1, the lubricant is suitably supplied onto the photosensitive drum 21 by the lubricant supply means 25 to 27.

In the cleanerless system, when the brush roller 26 contacts the photosensitive drum 21 during image formation, untransferred toner adheres to the brush roller 26 and the supply of solid lubricant is inhibited. In addition, when the untransferred toner adhering to the brush roller 26 moves onto the photosensitive drum 21, the untransferred toner contaminated by a large amount of lubricant contacts the charge unit 22 and the development roller 23*a*, making contact with the toner T within the developing unit 23, and produces secondary contamination. Thus, the cam 27 is used in the present Embodiment 1; the brush roller 26 is released from the photosensitive drum 21 during image formation, the brush roller 26 is controlled to make contact with the photosensitive drum 21 at a specified timing when not forming an image.

Here, the timing at which the brush roller 26 contacts the photosensitive drum 21 is before and after image formation, and may be the timing by which the photosensitive drum 21 rotates or the timing between pages if lubricant is coated when pages continually pass through.

In this way, in the present Embodiment 1, lubricant is supplied onto the photosensitive drum 21 during non-image formation when no untransferred toner is present, and therefore, the untransferred toner adhering to the photosensitive drum 21 during transfer processing adheres to the surface of the drum through the lubricant. For this reason, the adhesive force of the untransferred toner onto the photosensitive drum 21 is actually reduced, which improves the transfer rate and improves the efficiency of recovery of untransferred toner to the developing unit 23.

Here, the lubricant supplied onto the photosensitive drum 21 manifests a great lubrication effect by providing a thin pre-coat of lubricant on the surface of the photosensitive drum 21. Consequently, the lubricants are in a mutually congealed state. There is no cleaning blade in the cleanerless system, and therefore congealed lubricant arrives at the positions of the charge unit 22 and the developing unit 23 without the congealed lubricant spreading out. When the charge unit 22 contacts the photosensitive drum 21, there is an action by which the charge unit. 22 spreads the lubricant, but when the charging unit 22 does not contact the photosensitive drum 21 as in the present Embodiment 1, the lubricant is spread by the developing unit 23.

Concretely, the effect of the developing unit 23 spreading the congealed lubricant is obtained by the fact that the magnetic brush on the development roller 23*a* is densely formed as previously stated. When the charge unit 22 is not touching the photosensitive drum 21, the spreading effect by the magnetic brush is obtained by the fact that a dense magnetic brush is formed. In contrast, even if the charge unit 22 is made to not contact the photosensitive drum 21, the congealed lubricant that is not spread by the charge unit 22 can be spread in conjunction with the congealed lubricant that is not spread by the charge unit 22 adhering to the carrier C based on the fact that the magnetic brush is densely formed.

The lubricant spread on the photosensitive drum 21 by the rubbing of the magnetic brush in this way contributes in subsequent image formation to the improvement of the transfer rate by mediating between the untransferred toner and the photosensitive drum 21, and to the improvement of the efficiency of recovering the untransferred toner. Moreover, even if the magnetic brush contacts the photosensitive drum 21 at a relatively high velocity, the sliding impact of the magnetic brushes on the surface of the photosensitive drum 21 is mitigated by the mediation of the lubricant between the magnetic brush and the photosensitive drum 21, and less carrier C surface coating layer peels off. Further, parent resin of the toner particles T and external additives that make pressure contact between the magnetic brush and the photosensitive drum 21 have difficulty adhering to the carrier C, and degradation of the carrier C characteristics is reduced because the lubricant is present on the surface of the carrier C and the photosensitive drum 21.

Meanwhile, the lubricant adhering to the carrier C from the photosensitive drum 21 by the rubbing of the magnetic brush suppresses the adhesion of the toner parent resin and of external additives to the carrier C, and deters the degradation of the characteristics of the carrier C. In this way, even when new carrier C together with new toner T are supplied to the developing unit 23 from the replenishing cartridge 28, no great difference in characteristics is produced between new carrier C and the previously supplied carrier C within the developing unit 23. Consequently, when recovering untransferred toner into the developing unit 23, irregularities in recovery performance caused by fluctuations in the characteristics of the magnetic brush can be deterred.

Moreover, when lubricant continues to adhere to the magnetic brush over a period of time, the carrier becomes contaminated by the lubricant, and the friction charge performance is reduced in relation to the toner. In the present embodiment 1, the carrier within the developing unit 23 is replaced to a suitable degree, and the advance of carrier degradation can be weakened because a carrier discharge means is provided which automatically discharges excess carrier C.

The above effect becomes particularly manifest when using a process in which the untransferred toner is discharged and is prone to degrade when passing through the charge unit 22 (a contact charge system in which the charge unit 22 is made to contact the photosensitive drum 21), and a process in which the charge unit 22 is arranged to have a gap of 5 to 200 μm in relation to the photosensitive drum 21 (near-contact charge system). Further, if AC voltage is applied by the charge unit 22, the above described effect becomes larger because the discharge degradation of the untransferred toner is increased.

When using the image formation apparatus of the present Embodiment 1 and an apparatus that left out the lubricant supply means 25 to 27 from the image formation apparatus of the present Embodiment 1 to conduct repeated image formation respectively, the present inventors confirmed that the former apparatus had a smaller amount of untransferred toner on the photosensitive drum 21 compared to the latter apparatus, and the amount of toner derived substance adhering to the magnetic brush (parent resin and external additives, etc.) was also reduced.

As explained above, in the present Embodiment 1, even when jointly using a trickle development system with a cleanerless system, disadvantages such as irregular recovery of untransferred toner and the advance of carrier degradation can be deterred, and durability can be achieved because the apparatus is configured such that lubricant is supplied onto the photosensitive drum 21.

The effects of the present Embodiment 1 are summarized below.

The characteristic configuration of the present Embodiment 1 is that lubricant is supplied to the surface of the photosensitive drum 21 such that the lubricant adheres to the carrier based on image formation over time. The lubricant supplied on the photosensitive drum 21 by the lubricant supply means 25 to 27 arrives at the development region with the primary particles congealed because the lubricant is not spread out by a cleaning blade, etc. Then, the lubricant contacts the carrier that has spiked up in the development region, part of the lubricant adheres to the surface of the carrier, and the rest of the lubricant is spread onto the photosensitive drum 21 by rubbing with the carrier. Here, "to spread" means that lubricant present in a congealed state is mechanically drawn and extended to make a thin coat on the photosensitive drum 21.

From the perspective of the cleanerless system, configured in this way, even if the trickle development system is used and the electric field at the tip of the magnetic brush is not even, the untransferred toner adhering to the photosensitive drum 21 can be efficiently recovered. This is because the adhesive force of the untransferred toner in relation to the photosensitive drum 21 is weakened by the simple presence of the lubricant, and because the characteristics of the carrier at the tip of the magnetic brush are made uniform by the presence of the lubricant. Specifically, even if the relative velocity of the developing roller 23*a* and the photosensitive drum 21 is high, a small quantity of lubricant adheres to the carrier when the carrier contacts photosensitive drum 21, and therefore parent resin and external additives have difficulty adhering to the carrier even when pressure contact is made on toner particles between the magnetic brush and photosensitive drum 21. Consequently, degradation of the electric characteristics of the carrier is suppressed.

Moreover, the worsening of the fluidity of the carriers is reduced over time because lubricant as well as foreign matter adheres to the carrier, and the phenomenon of changes in the flexibility and strength of the magnetic brush over time is deterred. In this way, the electrical and physical characteristics of the carrier are stable over time, and therefore recovery of the untransferred toner by the developing unit 23 becomes easy, and a cleanerless system without disadvantages is achieved.

Generally, it is not preferable to mix lubricants on the developing unit 23. The main reason is that the surface characteristics of the carrier are changed by excess lubricant adhering to the carrier, and the frictional charge capacity on the toner particles deteriorates. This disadvantage becomes notably manifest in a cleanerless system in which there is no positive removal of the lubricant on the surface of the photosensitive drum 21 by a cleaning blade, etc. For this reason, it has been difficult to realize a method to supply lubricant on the photosensitive drum 21 in a cleanerless system irrespective of the effects of improved recovery of untransferred toner on the photosensitive drum 21 and improved transfer rate when mediated by a lubricant.

In the present Embodiment 1, the trickle development system is jointly used with the cleanerless system, and therefore carrier can be discharged outside of the developing unit 23 before lubricant adhering to that carrier has a deleterious effect on the image. For this reason, lubricant can be used in a cleanerless system.

Next, from the perspective of a trickle development system, adhesion of the toner parent resin and external additives to the carrier can be deterred, even when using a cleanerless system and the magnetic brush makes strong contact with the photosensitive drum 21, because lubricant is supplied to the carrier from the photosensitive drum 21. Exaggerated fluctuations in characteristics between new and old carrier, which is the disadvantage of the trickle development system, can thereby be deterred.

Moreover, in the present Embodiment 1, the complementary characteristics as a system can be enhanced by the fact that the spikes of the magnetic brush are densely formed.

First, when the spikes of the magnetic brush are densely formed, the characteristics of residual toner recovery by the magnetic brush can be improved, and a satisfactory effect to spread the lubricant longitudinally can be obtained. In a system using a cleanerless system, simply supplying lubricant to the photosensitive drum 21 cannot alone sufficiently fulfill the function of the lubricant to reduce the adhesive force of the untransferred toner in relation to the photosensitive drum 21. This is because if this lubricant is not spread out, it will not be possible to form an even lubricant layer on the surface of the photosensitive drum 21.

When a cleaning blade is set up, the cleaning blade fulfills the function of spreading out the lubricant on the photosensitive drum 21, but the lubricant adheres to the photosensitive drum 21 as a congealed lump when using a cleanerless system. In this state of adhesion, the effect to reduce the adhesive force of the untransferred toner in relation to the photosensitive drum 21 remains low. However, when spreading the lubricant by forming a dense magnetic brush as in the present Embodiment 1, the lubricant can be spread on the surface of the photosensitive drum 21, and satisfactory function to reduce adhesive force can be achieved even when a cleaning blade has not been provided.

Secondly, by using a cleanerless system it is possible for a suitable amount of lubricant to adhere to the carrier even when lubricant is not excessively present on the photosensitive drum 21. If as in the past a cleaning blade is provided and lubricant is spread upstream of the developing unit 23 by the cleaning blade, there is the difficulty that, unless an amount of lubricant that exceeds the necessary amount is supplied on the photosensitive drum 21 in order to manifest the effect to reduce adhesive force, the lubricant vigorously adheres to the magnetic brush. For example, when using a metal soap such as zinc stearate, the spread metal soap forms a lamellar structure, and a layer comprising a build up of molecules that stand up at a specified angle in relation to the surface of the photosensitive drum form a layered structure laminated up and down. Even when trying to make the lubricant adhere to the magnetic brush by rubbing lubricant on the magnetic brush in this kind of state, the lubricant only slides between layers and little adheres to the carrier.

However, if a cleanerless system is used, the lubricant contacts the carrier in the congealed state without being spread upstream of the development region. Then, part of that adheres to the carrier in a specified percentage. For this reason, it becomes possible to make the lubricant positively adhere to the carrier, and fluctuations of carrier characteristics, which are a disadvantage of the trickle development system, can be reduced and the lubricant can be made to adhere to the carrier.

Here, as a method to heighten the density of the spikes of the magnetic brush, a configuration can be made that drastically weakens the interaction between the carrier and the magnetic field facing the normal direction from the surface of the developing roller 23*a* as the developer support member. If the interaction is weakened, it becomes difficult for the carrier to be supported along the magnetic field at the tip of the magnetic brush, and the height of the spikes of the magnetic brush is lowered. In order to weaken the interaction between the carrier and the magnetic field, the modulus of decay of the magnetic flux density in the normal direction of the developing roller 23*a* is set to 40% or more.

Further, in the present Embodiment 1, the carrier forms in low magnetization and the modulus of decay of the magnetic flux density in the normal direction of the developing roller 23*a* is set to 40% or more, but even if only one of these is implemented, it is possible to obtain the same effect as in the present Embodiment 1. Specifically, the density of the spikes of the magnetic brush can be sufficiently heightened by forming the carrier in low magnetization. Moreover, the density of the spikes of the magnetic brush can be sufficiently heightened by setting the modulus of decay of the magnetic flux density in the normal direction of the developing roller 23*a* to 40% or more.

Supplying lubricant on the photosensitive drum 21 in this way makes joint use of a trickle development system and a cleanerless system easy. Then, in a system that forms an electrostatic latent image corresponding to the image information by first applying a uniform charge, the previously described effects become particularly effective in relation to a charge system that applies voltage to the charge unit 22 and produces a discharge by the charge unit 22 touching or nearly touching the photosensitive drum 21.

Specifically, if using this kind of charge system in a cleanerless system, the untransferred toner receives a discharge when passing through the position of the charge unit 22. At this time, the macromolecules forming the toner are made into lower weight molecules, and external additives are prone to be released by the impact of the discharge. This phenomenon becomes particularly evident when the uniformity of the charge is improved by applying AC voltage in relation to the charge unit 22 and producing discharge in both directions.

The toner that has been made into low weight molecules by the discharge is prone to deform and fuse by physical shock and heat, and parent resin tends to adhere to the carrier based on strong contact with the carrier. Moreover, released external additives are also prone to adhere to the carrier. Compared to the lubricant, the parent resin thickly adheres to the carrier and therefore causes large changes in the physical properties of the carrier. In addition, because the external additives have a reverse polarity charge to that of the carrier in order to carry out charge functions in the toner, the external additives are prone to adhere to the carrier and to drastically reduce the frictional charge capacity. Consequently, when using a charge system utilizing discharge, the adhesion of toner derived substances can be reduced by a small amount of lubricant adhering to the carrier.

Embodiment 2

Embodiment 2 of this invention will be explained in detail using FIG. 7.

Figure 7:
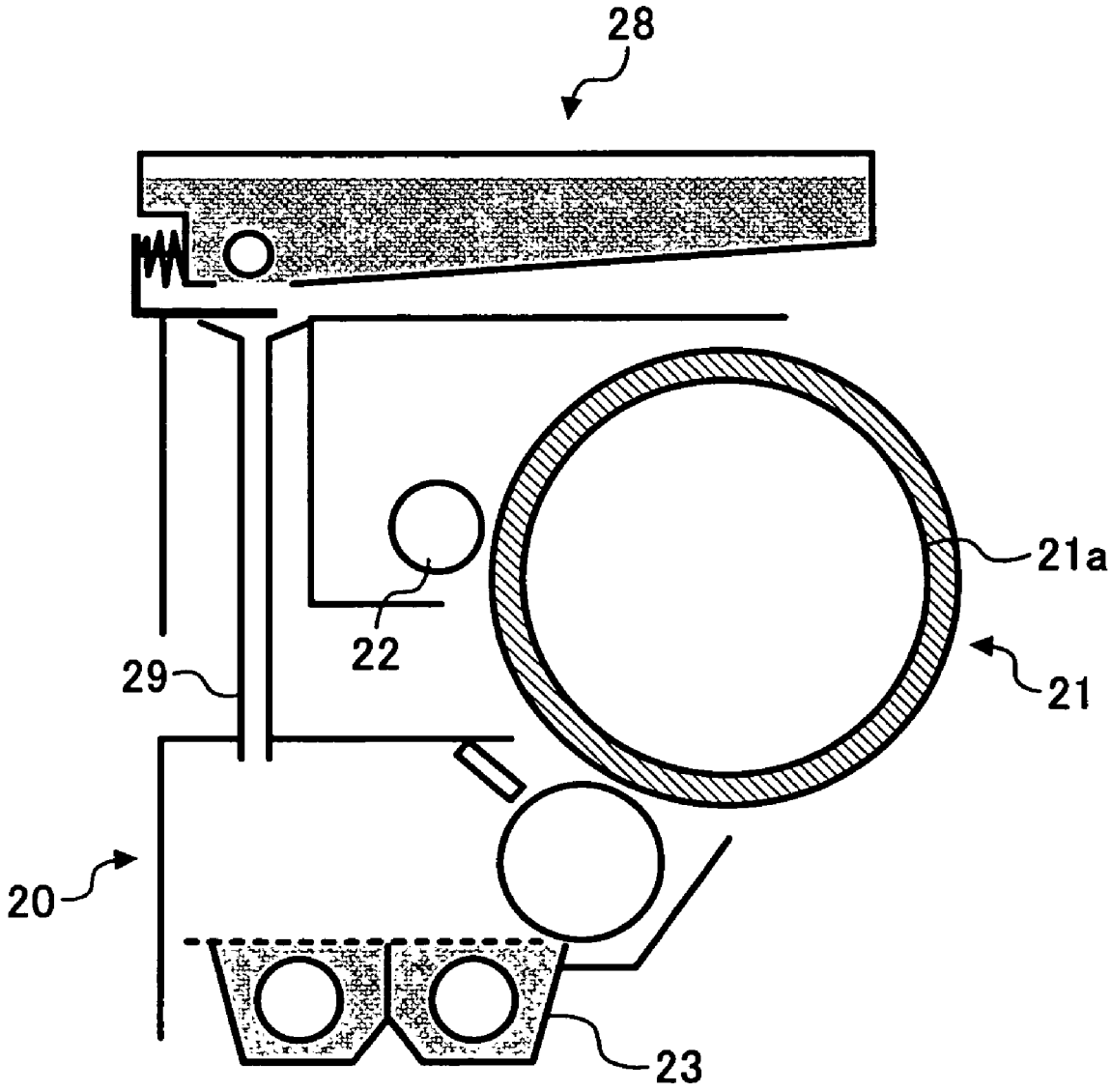
FIG. 7 is a configuration diagram indicating the process cartridge in Embodiment 2 of this invention.

FIG. 7 indicates the process cartridge and replenishing cartridge installed in an image formation apparatus of the present Embodiment 2. The aforementioned Embodiment 1 was configured to coat lubricant by using contact of the brush roller 26 with the photosensitive drum 21 as the lubricant supply means, and the present Embodiment 2 differs on the point that the configuration has lubricant contained in the photosensitive layer 21*a* of the photosensitive drum 21 as the lubricant supply means.

Referring to FIG. 7, no member such as brush roller 26, etc. of the aforementioned Embodiment 1 is set up in the process cartridge 20 of the present Embodiment 2, and lubricant is contained in the photosensitive layer 21*a* of the photosensitive drum 21. In more detail, the photosensitive drum 21 is a negative charge organic photosensitive member with an external diameter of 30 mm, and photosensitive layer 21*a* is formed on an aluminum cylinder substrate laminated by successive immersion coating of the various layers of a conductive layer, an undercoat layer, a charge generation layer, and a charge transport layer.

In addition to correcting defects, etc. of the aluminum cylinder substrate, the conductive layer is provided in order to prevent generation of moire cause by reflection of the exposure light L. The conductive layer has a film thickness of 10 μm in which tin oxide and titanium oxide powders are dispersed in a phenol resin.

The undercoat layer plays the role of preventing the positive charge infused into the aluminum cylinder substrate from canceling the negative load charged on the surface of the photosensitive drum. The main component of the undercoat layer is altered nylon or copolymer nylon with a film thickness of 0.6 μm.

The main component of the charge generation layer is a substance with an azo dye having absorbance in all wavelengths dispersed in a butyral resin with a film thickness of 0.6 μm. The charge generation layer generates a positive and negative charge pair by receiving the exposure light L.

The main component of the charge transport layer is a substance in which a hole-transport triphenylamine compound is dissolved in a polycarbonate resin (molecular weight of 20,000 based on Ostwald viscosity) at a 8:10 mass ratio, and 10 mass% of polytetrafluoroethylene resin particles (volume mean particle size of 0.2 μm) in relation to the total solid content are added and evenly dispersed to make a layer with a film thickness of 25 μm.

In order to control the characteristic changes of the carrier, it is preferable to set the contact angle of the photosensitive drum 21 in relation to the water in the range of 85 to 95 degrees. In the present Embodiment 2, lubricant such as polytetrafluoroethylene resin particles, etc. are dispersed and contained in the charge transport layer of the photosensitive drum 21. It is thereby possible to adjust the contact angle of the photosensitive drum 21 in relation to the water in the range of 85 to 95 degrees. Further, the contact angle is measured by a "Contact Angle Meter Model CA-X" (manufactured by Kyowa Interface Science Co., Ltd.) using purified water.

According to the configuration of the present Embodiment 2, even if the relative velocity of the photosensitive drum 21 and the magnetic brush is increased in order to improve the efficiency of removing untransferred toner to the developing unit 23, the peeling off of the carrier film coating by rubbing between the tip of the magnetic brush and the surface of the photosensitive drum 21 can be deterred. Moreover, even when pressure contact is applied to the toner between the tip of the magnetic brush and the photosensitive drum 21, the physical stress on the toner can be reduced by the toner sliding on the surface of the photosensitive drum 21, and adhesion of parent resin and external additives to the carrier can be deterred.

Moreover, in the present Embodiment 2 the lubricant supply means is taken to be the photosensitive drum 21 itself. Specifically, the apparatus is configured to contain the lubricant in the photosensitive layer 21*a* of the photosensitive drum 21. Consequently, compared to the configuration of the aforementioned Embodiment 1, in which lubricant was directly coated on the photosensitive drum 21, the effect to reduce the characteristic changes of the carrier is smaller because lubricant does not positively adhere to the surface of the carrier. However, the effect to deter deterioration of the characteristics of the carrier is sufficient compared to when a photosensitive drum 21 that does not contain lubricant is used. Consequently, the electric field at the tip of the magnetic brush and the flexibility and strength of the magnetic brush itself can be made uniform even if old and new carriers are mixed when recovering untransferred toner to the developing unit 23, and the recovery efficiency can be improved.

Moreover, joint use with an untransferred toner recovery system by the developing unit 23 (cleanerless system) deters the expansion of fluctuations in the characteristics of the old and new carriers based on the trickle development system, and the uniformity of the toner image formed on the photosensitive drum 21 can be stabilized even over time.

As explained above, in the present Embodiment 2, the generation of such disadvantages as irregular recovery of untransferred toner and the advance of carrier degradation can be prevented and durability achieved even when jointly using a trickle development system and a cleanerless system because the configuration is such that lubricant is contained in the photosensitive layer 21*a* and the lubricant is supplied on the photosensitive drum 21.

Embodiment 3

Embodiment 3 of this invention will be explained in detail using FIG. 8.

Figure 8:
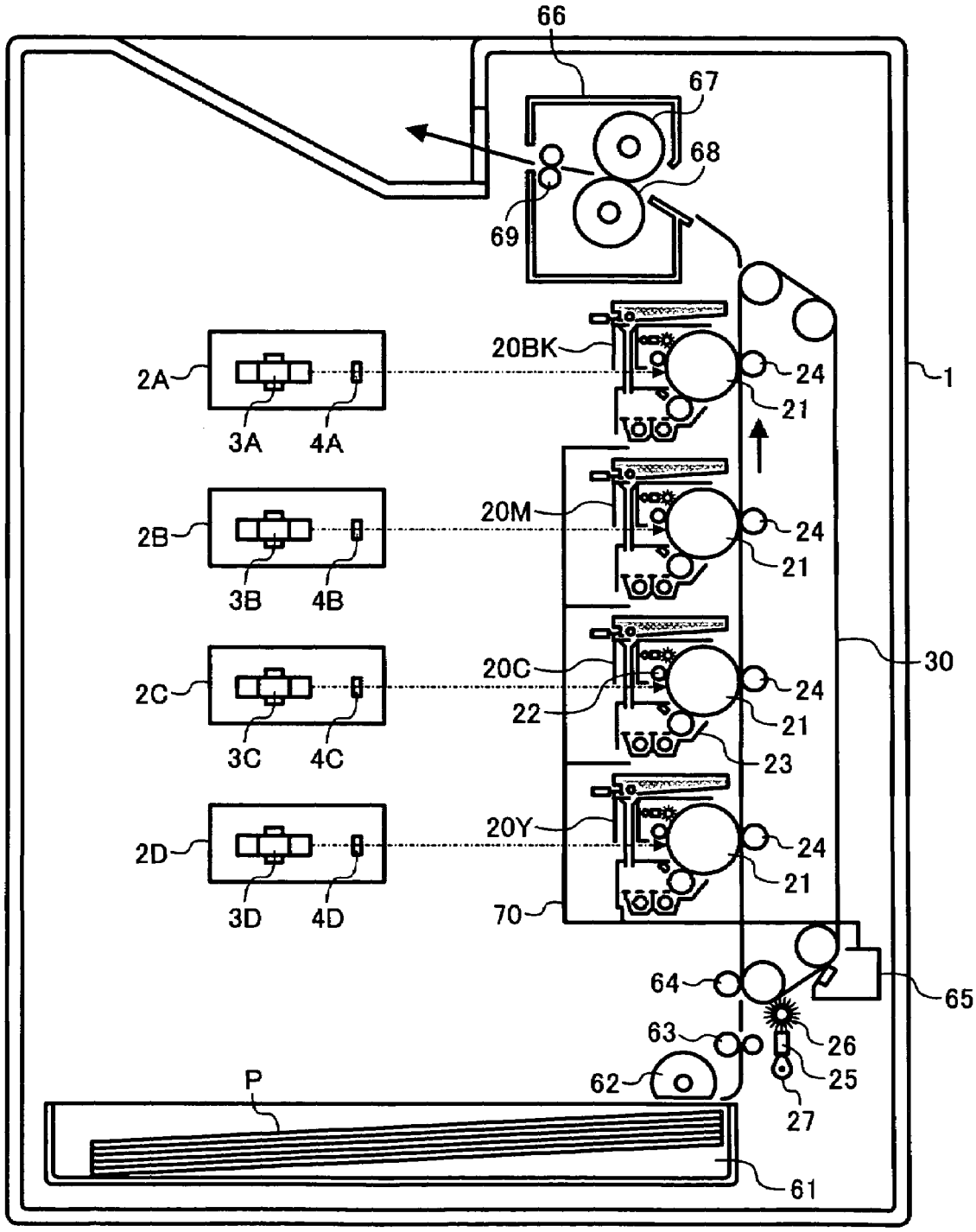
FIG. 8 is a configuration diagram indicating the image formation apparatus of Embodiment 3 of this invention.

FIG. 8 indicates the image formation apparatus of the present Embodiment 3. The present Embodiment 3 differs from the aforementioned Embodiment 1, in which the lubricant supply means 25 to 27 was provided in the position of the photosensitive drum 21 on the point that the lubricant supply means 25 to 27 is provided in the position of the transfer belt 30.

As indicated in FIG. 8, the lubricant supply means 25 to 27 of the embodiment 3 is not installed in the process cartridges 20BK, 20M, 20C, and 20Y, and is provided on the outer circumference of the transfer belt 30 as the transfer member.

In more detail, in the same way as the device in the aforementioned Embodiment 1, the lubricant supply means is configured by a solid lubricant 25, a brush roller 26 for supplying the lubricant 25 onto the transfer belt 30, and a cam 27 for separating the process roller 26 from the transfer belt 30. The lubricant supply means 25 to 27 is downstream of the belt cleaner 65 as seen from the direction that the transfer belt 30 runs, and the process cartridges 20Y, 20C, 20M, and 20BK are provided on the upstream side. The lubricant is thereby supplied from the lubricant supply means 25 to 27 to the developing unit 23 through the transfer belt 30.

In an image formation apparatus configured in this way, if lubricant is supplied to the transfer belt 30 during image formation, in the transfer position (position of transfer roller 24) the lubricant will adhere to the toner adhering to the surface of the photosensitive drum 21 from the transfer belt 30 side. The adhesive force between the toner and the transfer belt 30 thereby decrease, and the transfer efficiency will be reduced. In order to avoid this kind of disadvantage in the present Embodiment 3, the cam 27 is controlled to provide the lubricant on the transfer belt 30 when the image is not being formed.

As explained above, in the present Embodiment 3, the generation of such disadvantages as irregular recovery of untransferred toner and the advance of carrier degradation can be prevented and durability achieved even when jointly using a trickle development system and a cleanerless system because the configuration supplies lubricant onto the photosensitive drum 21 through the transfer belt 30 as the contact member.

The configuration of the present Embodiment 3 is particularly advantageous when desiring to further simplify the configuration of the process cartridge, and when supplying a comparatively large amount of lubricant only to a specified process cartridge (process cartridge nearest to the lubricant supply means).

Further, in the present Embodiment 3, lubricant was supplied onto the photosensitive drum 21 through the transfer belt 30. In contrast, if the image formation apparatus has an intermediate transfer belt or transfer roller, etc. that directly contacts the photosensitive drum 21, lubricant can be supplied onto the photosensitive drum 21 through a transfer member such as the intermediate transfer belt or transfer roller, etc.

Forms other than the aforementioned Embodiments 1 to 3 will be explained below.

In the aforementioned embodiments, developer G of a specified mixture percentage (of carrier C and toner T) was housed in the replenishing cartridge 28, and this developer G was suitably supplied to the developing unit 23. Specifically, in the aforementioned embodiments the supply of the toner for replenishing the toner consumed in the developing unit 23 and the supply of the carrier for implementing the trickle development system were implemented at the same time. In other words, the toner was supplied simultaneously by the carrier supply unit.

In contrast, the supply of the toner for replenishing the toner consumed in the developing unit 23 and the supply of the carrier for implementing the trickle development system may be implemented at differing timings respectively.

Concretely, the interior of the replenishing cartridge explained in the aforementioned Embodiment 1 may be divided into a chamber housing only toner and a chamber housing only carrier. Then, two refill tubes 29 are installed from the respective chambers through to the developing unit 23. According to a replenishing cartridge configured in this way, the supply of carrier and the supply of toner are implemented at separate timings.

The reason for the separate implementation of the supply of carrier and the supply of toner in this way is because the optimum replacement periods for the toner and carrier during trickle development do not always coincide. For example, when comparing the output of 10000 copies of an image with 100% image surface area percentage to the output of 10000 copies of an image with 5% image surface area percentage, the advance of contamination of the carrier is nearly equivalent for both because the toner and carrier are agitated just the same amount of time. Notwithstanding, the former consumes about 20 times the amount of toner that the latter does. Consequently, in a system in which the toner and carrier are simultaneously supplied (as in all the aforementioned embodiments), in contrast to supplying the toner and carrier and refreshing the carrier in the former case, image degradation may occur in the latter case even if the carrier is sufficiently replaced because the amount of toner consumption was low.

Thus, as a configuration that independently supplies the toner and carrier respectively, the supply of toner is made to correspond to the amount of toner consumed in the developing unit 23, and the supply of carrier is made to correspond to the degree of agitation within the developing unit 23. For example, the supply of toner is implemented accorded to the cumulative number of images formed, and the supply of carrier is implemented corresponding to the cumulative number of images formed (for example, supplied every 1000 copies) or according to the cumulative agitation time (for example, supplied every 10 hours of cumulative agitation time).

It is thereby possible to replace carrier at the optimum timing, and the affect on image quality of excess lubricant adhering to the carrier can be reduced. Specifically, the above described configuration is advantageous when a cleanerless system is used because it is important to supply carrier while considering a balance between the adhesion of substances derived from toner onto the carrier and the adhesion of lubricant.

Further, another form will be explained.

In the aforementioned embodiments the discharge opening 23*d* was provided in a position at the specified height of the storage unit of the developing unit 23 as a carrier discharge means to discharge carrier outside of the developing unit 23.

In contrast, the carrier in the developing unit 23 may be proactively made to adhere to the photosensitive drum 21 as the carrier discharge means.

Concretely, if the carrier replacement period has been determined, the controller of the image formation apparatus enters into the carrier discharge mode. In this carrier discharge mode, while driving the photosensitive drum 21 and the transfer belt 30 in the same way as when forming images, the charge unit 22 is controlled such that the charge potential of the surface of the photosensitive drum 21 becomes a potential at which the carrier can be more easily attracted than when forming images (for example, 1000 V). By doing this, the electrostatic force that acts on the positively charged carrier overcomes the magnetic binding force by the developing roller 23*a*, and the carrier on the developing roller 23*a* is discharged to the surface of the photosensitive drum 21. In this carrier discharge mode, the rotational velocity of the developing roller 23*a* can be set higher than when forming images in order to promote this discharge of carrier.

The carrier discharged from the developing unit 23, directly supported on the photosensitive drum 21, reaches the position opposite the transfer roller 24. Transfer voltage differing from that when forming images (for example, −2000 V) is applied to the transfer roller 24, and the carrier adheres to the transfer belt 30. At this time, even if there is negatively charged toner discharged to the surface of the photosensitive drum 21 together with the carrier, the majority of the toner remains on the photosensitive drum 21 side and is again recovered by the developing unit 23 because the voltage applied to the transfer roller 24 is set to a voltage more negative than the surface potential of the photosensitive drum 21.

Meanwhile, the carrier adhering to the transfer belt 30 is recovered by a belt cleaner 65 that contacts the transfer belt 30.

The above described configuration of the carrier discharge means has a cost advantage compared to the aforementioned embodiments because it is not necessary to set up the discharge opening 23*d* of the developing unit 23 and the discharge route 70. Moreover, by jointly using with the cleanerless system, the toner discharged to the photosensitive drum 21 side together with the carrier is recovered again to the developing unit 23, which has the benefit of reducing waste.

Further, in the aforementioned embodiments, the present invention was applied to a tandem image formation apparatus in which carrier is automatically discharged from the discharge openings 23*d* of the developing units 23. However, the application of the present invention is not limited to this, and for example, the present invention may of course be applied to a revolving image formation apparatus in which multiple developing units are unified in a developing device that revolves and the developing units selectively oppose the photosensitive drum 21. In this case, the degraded carrier in the developing unit can be discharged using the rotational action of the developing device.

Moreover, in the aforementioned embodiments, the present invention was applied to an image formation apparatus in which part of the imaging unit was configured by the process cartridges 20. However, the application of the present invention is not limited to this, and the present invention can of course be applied to an image formation apparatus in which the imaging unit is not made into processing cartridges.

The present invention can offer a durable image formation apparatus and process cartridge that do not produce such disadvantages as irregular recovery of untransferred toner and the advance of carrier degradation even when jointly using a trickle development system and a cleanerless system because the configuration is such that a lubricant is supplied onto the image support member.

Further, the present invention is not limited to the aforementioned embodiments, and it is clear that suitable modifications other than those suggested can be made to the embodiments in the range of the technical idea of the present invention. The number, position, shape or the like of the above-mentioned constitutional members are not limited to the aforementioned embodiments and can be those suitable to implement the present invention.

What is claimed is:

1. An image formation apparatus comprising:

an image support member on which a latent image is formed;

a developing unit that houses developer having carrier and toner, develops the latent image formed on the image support member, and recovers untransferred toner remaining on the image support member;

a carrier supply unit that supplies carrier to the developing unit;

carrier discharge means that discharges carrier housed in the developing unit to a storage unit located outside of the developing unit; and lubricant supply means that supplies lubricant onto the image support member.

2. The image formation apparatus as claimed in claim 1, wherein the lubricant supply means comprises means to supply lubricant onto the image support member through a contact member that contacts the image support member.

3. The image formation apparatus as claimed in claim 2, wherein the contact member comprises a brush roller.

4. The image formation apparatus as claimed in claim 2, further comprising:

a transfer member that transfers the toner image formed on the image support member to a transfer receiving material, wherein the contact member is the transfer member.

5. The image formation apparatus as claimed in claim 1, wherein the image support member contains lubricant, and the lubricant supply means is the image support member itself.

6. The image formation apparatus as claimed in claim 1, wherein the lubricant is zinc stearate or polytetrafluoroethylene.

7. The image formation apparatus as claimed in claim 1, wherein the carrier is formed such that the amount of magnetization in a magnetic field of one kilo-Oersted is in the range of 30 to 200 emu/cm$^3$.

8. The image formation apparatus as claimed in claim 1, wherein the developing unit comprises a developer support member on which a magnetic field generated by an inbuilt magnetic field generation member makes developer spike up at a position opposite to the image support member; and the magnetic field generation member is formed such that the modulus of decay of the normal direction magnetic flux density of the generated magnetic field is 40% or more. image support member by varying a transfer electric field formed by the transfer member.

9. The image formation apparatus as claimed in claim 1, wherein the developing unit comprises a discharge opening connected to the outside at a position of a specified height in the developer housing unit; and the carrier discharge means is means to discharge developer exceeding the specified height from the discharge opening.

10. The image formation apparatus as claimed in claim 1, wherein the carrier supply unit also supplies toner to the developing unit.

11. The image formation apparatus as claimed in claim 1, further comprising:

a charge unit that charges the image support member using a discharge produced by applying voltage.

12. An image formation apparatus, comprising:

an image support member on which a latent image is formed;

a developing unit that houses developer having carrier and toner, develops the latent image formed on the image support member, and recovers untransferred toner remaining on the image support member;

a carrier supply unit that supplies carrier to the developing unit;

carrier discharge means that discharges carrier housed in the developing unit to outside of the developing unit; and lubricant supply means that supplies lubricant onto the image support member, the lubricant supply means including a contact member configured to freely engage and disengage to and from the image support member, wherein the contact member is controlled to be separated from the image support member when image formation is implemented on the image support member, and to contact the image support member when image formation is not implemented on the image support member.

13. An image formation apparatus, comprising:

an image support member on which a latent image is formed;

a developing unit that houses developer having carrier and toner, develops the latent image formed on the image support member, and recovers untransferred toner remaining on the image support member;

a carrier supply unit that supplies carrier to the developing unit;

carrier discharge means that discharges carrier housed in the developing unit to outside of the developing unit;

lubricant supply means that supplies lubricant onto the image support member;

a charge unit that charges the image support member; and a transfer member that transfers the developed image formed on the image support member to a transfer receiving material, wherein the carrier discharge means is means by which the carrier housed in the developing unit is made to adhere to the image support member by varying a charge potential formed on the image support member by the charge unit, and the adhering carrier is removed from the image support member by varying a transfer electric field formed by the transfer member.

14. A process cartridge to be installed by freely attaching to and detaching from an image formation apparatus, the process cartridge comprising:

an image support member on which a latent image is formed;

a developing unit that houses developer having carrier and toner, develops the latent image formed on the image support member, and recovers untransferred toner remaining on the image support member;

a carrier supply unit that supplies carrier to the developing unit;

carrier discharge means that discharges carrier housed in the developing unit to a storage unit located outside of the developing unit; and lubricant supply means that supplies lubricant onto the image support member, wherein the image support member and the developing unit are unified.

15. The process cartridge as claimed in claim 14, wherein at least one of the carrier supply unit, the carrier discharge means, and the lubricant supply means is further unified with the image support member and the developing unit.

16. The process cartridge as claimed in claim 14, further comprising:

a charge unit that charges the image support member using a discharge generated by applying voltage, wherein the charge unit is further unified with the image support member and the developing unit.

17. An image formation apparatus, comprising:

an image support member configured to receive a latent image thereon;

a developing unit configured to receive developer having carrier and toner therein, to develop the latent image formed on the image support member, and to recover untransferred toner remaining on the image support member;

a carrier supply unit configured to supply carrier to the developing unit;

a carrier discharge unit configured to discharge carrier housed in the developing unit to a storage unit located outside of the developing unit; and a lubricant supply unit configured to supply lubricant to the image support member.

18. The image formation apparatus as claimed in claim 17, wherein the lubricant supply unit includes a contact member configured to freely engage and disengage the image support member and to supply lubricant to the image support member, the contact member is separated from the image support member when image formation is implemented on the image support member, and the contact member contacts the image support member when the image formation is not implemented on the image support member.

19. The image formation apparatus as claimed in claim 17, further comprising:

a charge unit configured to charge the image support member; and a transfer member configured to transfer the developed image formed on the image support member to a transfer receiving material, wherein the carrier discharge unit is configured to cause the carrier housed in the developing unit to adhere to the image support member by varying a charge potential formed on the image support member by the charge unit, and adhering carrier is removed from the image support member by varying a transfer electric field formed by the transfer member.

* * * * *